US007462079B2

(12) United States Patent
Fabian et al.

(10) Patent No.: US 7,462,079 B2
(45) Date of Patent: Dec. 9, 2008

(54) ELECTRICAL CONTACT WITH WIRE TRAP

(75) Inventors: David James Fabian, Mount Joy, PA (US); Timothy Lee Kocher, Camp Hill, PA (US); John Michael Landis, Camp Hill, PA (US); John Steven Wilson, Shermansdale, PA (US); Donald Alan Diemer, Oak Ridge, NC (US); Donald Michael Baughn, Burlington, NC (US)

(73) Assignee: Tyco Electronics Corporation, Middletown, PA (US)

( * ) Notice: Subject to any disclaimer, the term of this patent is extended or adjusted under 35 U.S.C. 154(b) by 49 days.

(21) Appl. No.: 11/532,075

(22) Filed: Sep. 14, 2006

(65) Prior Publication Data

US 2007/0111612 A1 May 17, 2007

Related U.S. Application Data

(63) Continuation-in-part of application No. 11/343,570, filed on Jan. 31, 2006, now Pat. No. 7,118,429.

(60) Provisional application No. 60/736,636, filed on Nov. 14, 2005.

(51) Int. Cl.
*H01R 11/22* (2006.01)

(52) U.S. Cl. ..... 439/852; 439/861; 439/739; 439/438; 439/749

(58) Field of Classification Search ..... 439/406, 439/427, 440–441, 805, 852, 859, 861, 438–439, 439/739, 749, 744
See application file for complete search history.

(56) References Cited

U.S. PATENT DOCUMENTS 3,059,214 A 10/1962 Heller
3,530,428 A 9/1970 Zak et al.
3,621,445 A 11/1971 Horecky et al.
3,748,634 A 7/1973 Barnes et al.
3,975,072 A 8/1976 Ammon
4,084,876 A * 4/1978 Dinger ..... 439/439
4,498,719 A 2/1985 Juris et al.
4,720,270 A 1/1988 Guenin et al.
4,729,740 A 3/1988 Crowe et al.

(Continued)

FOREIGN PATENT DOCUMENTS

DE 28 08 671 9/1979

(Continued)

OTHER PUBLICATIONS

International Search Report dated Jun. 29, 2007.

(Continued)

*Primary Examiner*—Truc T Nguyen

(57) ABSTRACT

An electrical terminal includes a body having a first end, a second end, and a channel having an axis. The channel extends at least through the first end toward the second end, the channel configured and disposed to receive an electrical conductor. A contact gripping element intermediate the first and second ends extends into the channel at an angle from the axis. The contact gripping element is associated with the body. The contact gripping element terminates at an end having a reduced thickness. The contact gripping element is configured to exert a contact gripping contact force on the electrical conductor.

20 Claims, 13 Drawing Sheets

U.S. PATENT DOCUMENTS

| | | | | |
|---|---|---|---|---|
| 6,019,521 | A | 2/2000 | Manning et al. | |
| 6,261,134 | B1 * | 7/2001 | Muzslay | 439/852 |
| 6,428,343 | B1 | 8/2002 | Landis et al. | |
| 6,827,613 | B2 | 12/2004 | Ferderer | |
| 6,890,192 | B2 * | 5/2005 | Riku | 439/108 |
| 7,118,429 | B1 | 10/2006 | Fabian | |

FOREIGN PATENT DOCUMENTS

| | | |
|---|---|---|
| DE | 202 02 788 | 6/2002 |
| DE | 102 53 858 A1 | 6/2004 |
| GB | 2 294 817 | 5/1996 |

OTHER PUBLICATIONS

International Search Report PCT/US2007/019477 dated Jun. 17, 2008.

Und-Order-Nor + Steuerungstechnik, "Safety First: Steckverbinder Fuer Die Kraftfahrzeugelektronik", Distribution Verlag GMBH; Jun. 1, 1992; p. 40, vol. 25, No. 6, Mainz, DE.

* cited by examiner

ELECTRICAL CONTACT WITH WIRE TRAP

CROSS-REFERENCE TO RELATED APPLICATIONS

This application is a continuation in part of application Ser. No. 11/343,570, filed Jan. 31, 2006, and a continuation in part of Application No. 60/736,636, filed Nov. 14, 2005.

FIELD OF THE INVENTION

The subject matter relates to an improved electrical terminal and more particularly to an improved wire trap for the electrical connection and retention of an electrical conductor within an electrical terminal of an electrical connector. The subject matter also relates to improved mating electrical connector housings capable of blind assembly and which, in their connected or engaged position, the external surface of the connector housings substantially lack external features capable of inadvertently capturing a portion of an element brought into physical contact with the external surface.

BACKGROUND OF THE INVENTION

Electrical terminals are well known in the connector industry. Typically, the terminals include a pin and mating socket, together with a conductor connecting portion. In the event that the terminals are connected to wires, the terminals include a wire connecting section. One such form of wire connecting section is the wire crimp, where the wire is stripped and placed in a terminal end, and then crimped in place where the metal deforms about the conductor to form the electrical connection.

It is desirable in certain applications to not require a crimped connection. Typically, this is in the situation where the wires are stripped on site, and where crimping tools are not readily available. An example of such a situation would be in the lighting industry where overhead lights are installed, and it is easier for the installer to not require a crimped connection.

However, problems can arise with non-crimped connections. For example, inadequate retention forces applied against the wires in the electrical terminal can result in inadvertent withdrawal of the wires from the electrical terminal, causing a discontinuity in the electrical circuit.

What is needed is an electrical terminal construction for providing reliable, crimpless electrical connections.

SUMMARY OF THE INVENTION

The present invention relates to an electrical terminal including a body having a first end, a second end, and a channel having an axis, the channel extending at least through the first end toward the second end. The channel is configured and disposed to receive an electrical conductor. A contact gripping element is intermediate of the first and second ends and extends into the channel at an angle from the axis. The contact gripping element is associated with the body. The contact gripping element terminates at an end having a reduced thickness, the contact gripping element being configured to exert a contact gripping contact force on the electrical conductor. In several variations, the contact gripping element is a beam or a leaf spring. Further embodiments include where the contact gripping element is resiliently moveable in a radial direction and where the insertion of the electrical conductor exerts a radial force upon the contact gripping element.

The present invention further relates to an electrical terminal for positioning in a connector housing. The electrical terminal includes a body having a first end, a second end, and a channel, the channel having an axis extending at least through the first end toward the second end, the channel configured and disposed to receive an electrical conductor. A contact gripping element is intermediate of the first and second ends and extends into the channel at an angle from the axis. The contact gripping element is associated with the body. The contact gripping element terminates at an end having a reduced thickness, the contact gripping element being configured to exert a contact gripping contact force on the electrical conductor. The body includes a locking portion configured to lock the body in the connector housing. The locking portion defines a locking shoulder, and the locking portion being positioned through the channel, whereby the locking shoulder is backed up by the body.

The present invention yet further relates to an electrical terminal for positioning in a connector housing. The electrical terminal includes a body having a first end, a second end, and a channel having an axis extending at least through the first end toward the second end, the channel configured and disposed to receive an electrical conductor. A contact gripping element is intermediate of the first and second ends and extends into the channel at an angle from the axis. The contact gripping element is associated with the body. The contact gripping element terminates at an end having a reduced thickness, the contact gripping element being configured to exert a contact gripping contact force on the electrical conductor. The body includes a locking portion configured to lock the body in a housing.

The present invention further relates to an electrical connector assembly including a first and a second electrical connector connectable along an axis, each electrical connector having a first and a second end. Each electrical connector includes a housing configured and dimensioned for receiving at least one electrical terminal, each electrical terminal of the first electrical connector making physical contact with a corresponding electrical terminal of the second electrical connector during connection thereof. A first keying arrangement polarizes to assure proper orientation of the first electrical connector with the second electrical connector during connection thereof. The housing of the first electrical connector has an extension portion extending longitudinally past the first end of the first electrical connector. The extension portion partially receives the first end of the second electrical connector to substantially axially align the first and second electrical connectors. The axial alignment is achieved prior to physical contact between corresponding electrical terminals of the first and second electrical connectors.

In another variation, the body includes a longitudinal seam extending along a length of the body from the open end to a second end of the body. Furthermore, the contact gripping element is transverse to the seam. In one embodiment, the body is configured such that the seam widens upon insertion of the electrical conductor into the channel. More preferably, the seam is configured to reduce the radial force applied upon the contact gripping element.

The seam comprises a way for relaxing stress on the contact gripping element. When an electrical conductor is inserted into the channel, the electrical conductor places a radial force on the contact gripping element. During insertion of the electrical conductor, the electrical conductor can place a force on the inside surface of the body on the side opposite of the contact gripping element. Since the contact gripping element is resiliently biased in the channel, this radial force may put stress on the contact gripping element at the point of association to the body of the electrical terminal. When the seam is transverse to the contact gripping element, the seam can widen and reduce the radial force placed upon the contact gripping element by the electrical conductor.

In yet another embodiment, a terminal for retention of an electrical conductor comprises an electrical terminal including a contact gripping element, a channel and an aperture. The contact gripping element is disposed through the aperture. The contact gripping element has a distal end disposed in the channel and is configured to be displaced by the electrical conductor where the contact gripping element is configured to exert a contact gripping force on the electrical conductor disposed in the channel. In two variations, the contact gripping element is an arch and a leaf spring.

Further embodiments include where the contact gripping element is resiliently moveable in a radial direction and where the insertion of the electrical conductor exerts a radial force upon the contact gripping element.

In another variation, the body includes a longitudinal seam extending along a length of the body from the open end to a second end of the body. Furthermore, the contact gripping element is transverse to the seam. Preferably, the body is configured such that the seam widens upon insertion of the electrical conductor into the channel. More preferably, the seam is configured to reduce the radial force applied upon the contact gripping element.

In one embodiment, the seam comprises a way for relaxing stress on the contact gripping element. When an electrical conductor is inserted into the channel, the electrical conductor places a radial force on the contact gripping element. During insertion of the electrical conductor, the electrical conductor can place a force on the inside surface of the body on the side opposite of the contact gripping element. Since the contact gripping element is disposed in the channel, this radial force may put stress on the contact gripping element at the point of association to the body of the electrical terminal. When the seam is transverse to the contact gripping element, the seam can widen and reduce the radial force placed upon the contact gripping element by the electrical conductor.

In another embodiment, an electrical terminal comprises a body having an aperture and a locking member extending from the body and at least partially out of the aperture where the locking member is configured to back up to the body. The locking member is configured to be biased by a housing. The locking member is configured to be biased from a first position to a second position which is toward the center of the body during insertion of the body into a housing, and to return to a third position away from the center of the body upon further insertion into the housing. The locking member extends through the aperture and backs up to the body. The locking member provides a structural member to abut the housing. The electrical terminal cannot freely move in a longitudinal direction relative to the housing because of the locking member abutting the housing.

The body includes a longitudinal seam extending along a length of the body. The locking member may be transverse to the seam. The aperture is located across the body from where the locking member associates with the body.

In yet another embodiment, the body further comprises a plurality of locking members, a plurality of point of connections, a plurality of apertures and a plurality of distal ends. At least one of the point of connections is configured to extend away from an adjacent side of the body, at least one of the distal ends configured to extend toward the adjacent side of the body. At least one of the distal ends has a greater width in a circumferential direction than at least one of the point of connections. In a variation at least one of the distal ends is configured to back up to the body during the body insertion into the housing. The electrical terminal cannot freely move in a longitudinal direction relative to the housing because of the locking member abutting the housing. In a variation at least one of the distal ends is disposed in a channel of the body through at least one of the apertures. In another variation at least one of the distal ends is not disposed in a channel of the body through at least one of the apertures. In a separate variation at least one of the apertures is defined by a cutout of a point of connection and at least one of the distal ends.

The body includes a projection where the projection is configured to abut a shoulder of the housing during the body insertion into the housing to thereby prevent further insertion of the body into the housing beyond a locking position. In a variation the projection is a rib where the rib is circumferentially disposed around the body.

An advantage of the present invention is that the terminal can be configured for installation in the connector housing from either direction. That is, the terminal can be installed in the same direction in the connector housing that the electrical conductor is received in the terminal, or in the opposite direction.

A further advantage of the present invention is that the contact gripping element reliably secures the electrical conductor.

A still further advantage of the present invention is that the electrical conductor can be secured without the need for a special tool.

A yet further advantage of the present invention is that the assembled or engaged connector housings substantially lack exterior surface features capable of inadvertently capturing a portion of an element brought into physical contact with the external surface.

An additional advantage of the present invention is an electrical assembly having mating connector housings that are capable of blind assembly.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
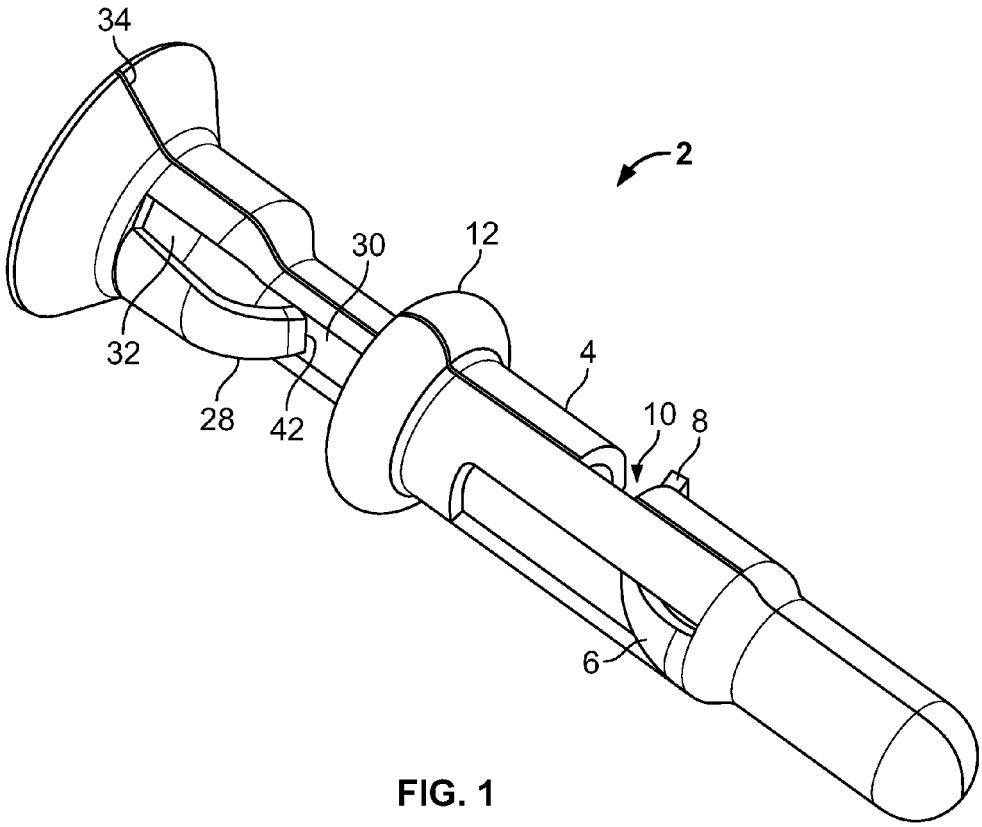
FIG. 1 is a perspective view showing an embodiment of the electrical terminal of the present invention.
Figure 2:
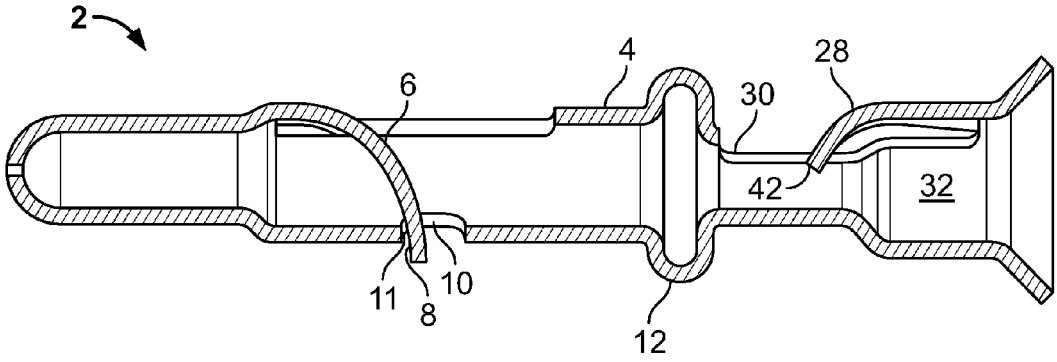
FIG. 2 is a longitudinal cross-sectional view through the terminal of FIG. 1 of the present invention.

The present invention, referring to FIG. 1, is directed to an embodiment of an electrical terminal 2, having a body 4, locking portion or member 6, defining a locking shoulder 8 extending through an aperture 10. Locking member 6 may be a cut out or a stamp out from body 4. Locking member 6 may be resiliently biased into an arch or beam structure and is shown as formed to extend through aperture 10. As best shown in FIG. 2, locking shoulder 8 is positioned adjacent to a forward edge 11 of body 4 which defines aperture 10.

Terminal 2 is preferably stamped and formed from a flat blank material, where the flat blank is roll formed into a pin or socket or similar configuration, and where the side edges of the blank are formed into an abutting longitudinal seam 34. The stamped terminal is comprised of an adequately conductive material, such as a copper alloy material. Locking member 6 is stamped from the blank which forms an opening in body 4, and locking member 6 is thereafter formed to extend through aperture 10.

Figure 3:
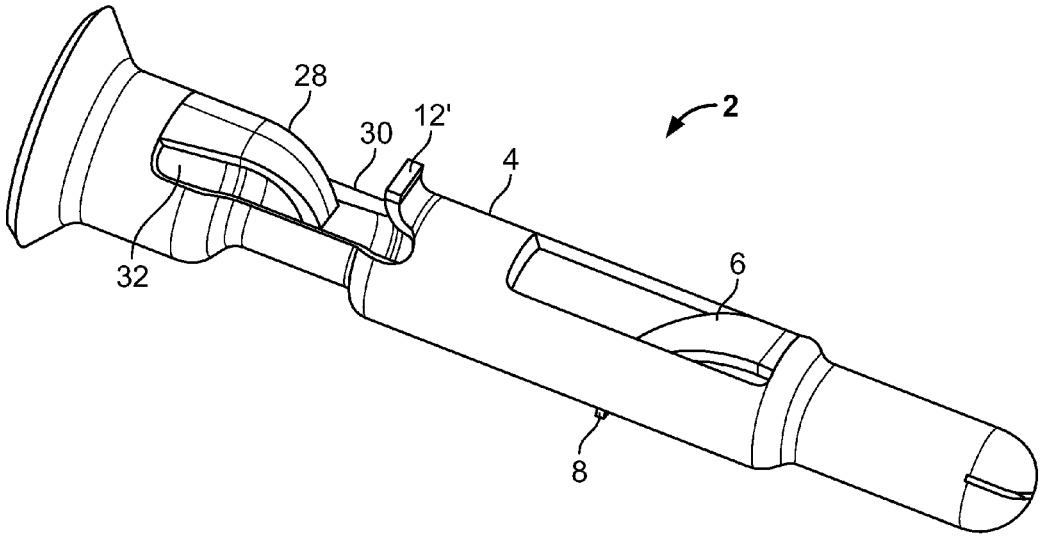
FIG. 3 shows an alternative projection of the terminal of FIG. 1 of the present invention.

Body 4 further includes projection 12. As further shown in FIG. 1, projection 12 is shown as a bulbous form extending around the periphery of body 4, but it should be appreciated that the projection could be one or more tabs cut out or stamped out from body 4. For example, and with reference to FIG. 3, the projection may be in the form of a tab 12' stamped from body 4.

Body 4 further includes contact gripping element 28, aperture 30, channel 32 and seam 34. As best shown in FIGS. 1 and 2, contact gripping element 28 is shown resiliently biased or extending into channel 32. Contact gripping element 28 may be cut out or stamped out from body 4, but as shown, is stamped from the blank of material from which it is formed. Therefore, terminal 2 is of unitary construction. Alternately, contact gripping element 28 could be separately provided and secured to body 4. Likewise, projection 12 and locking member 6 could be separately provided, i.e., not of unitary construction, or provided in combination together as a unitary construction or in combination with contact gripping element 28 and secured to body 4. Contact gripping element 28 may be resiliently biased into the form of a leaf spring or beam structure, as shown best in FIG. 2. The distal end 42 of contact gripping element 28 also forms a contact section as will be further described below. As explained therein, the contact gripping element defines a wire trap for contacting an exposed conductor of an insulated wire or a conductor of an uninsulated wire or a contact having a similar cross-section.

Figure 4:
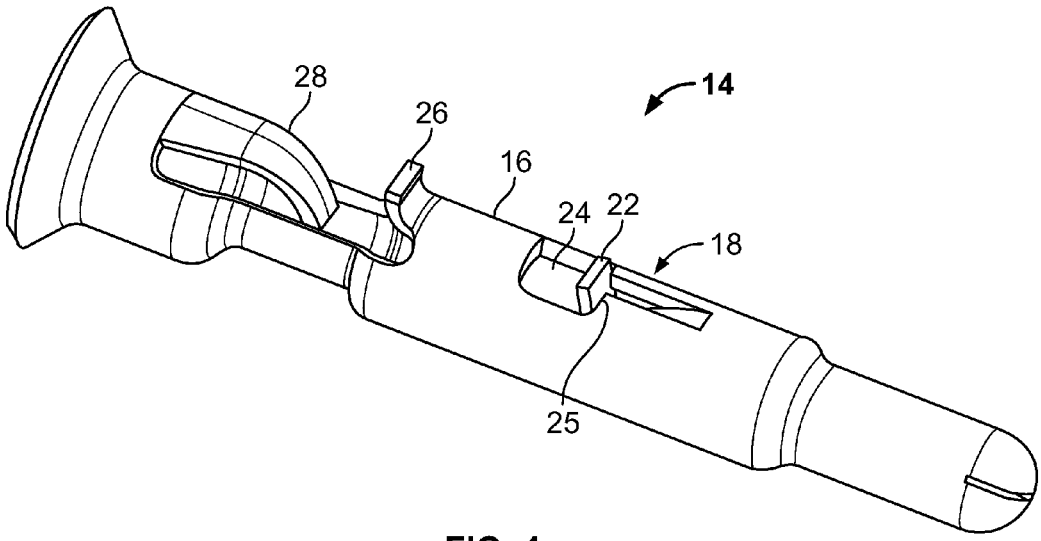
FIG. 4 is a perspective view showing a further embodiment of the electrical terminal of the present invention.
Figure 5:
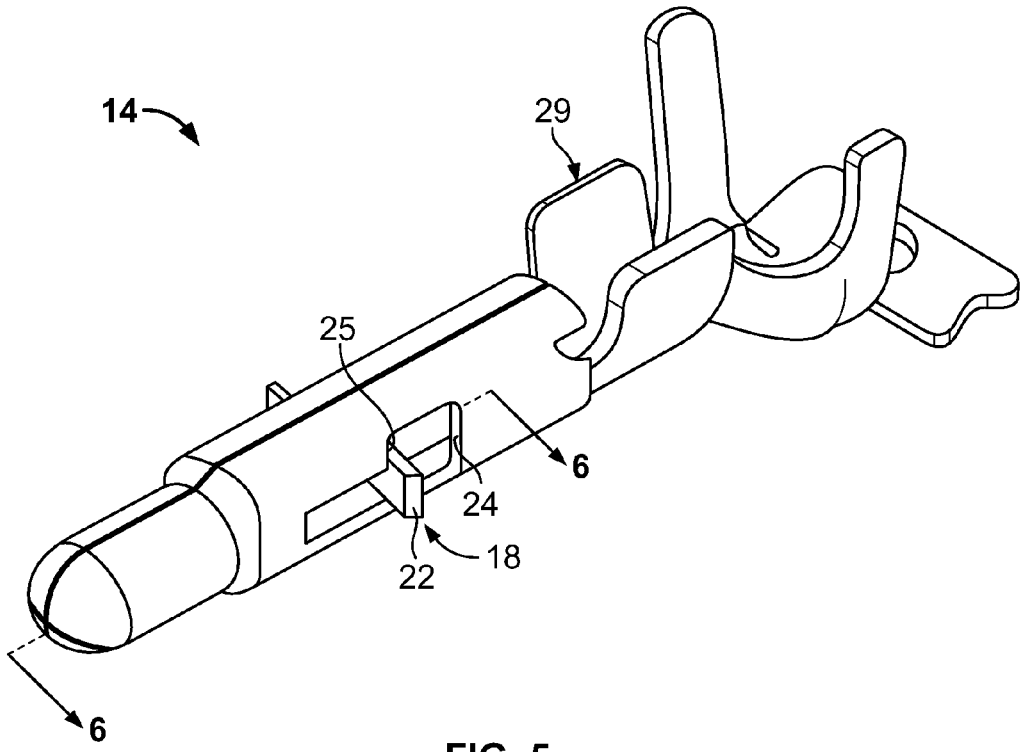
FIG. 5 is a perspective view similar to that of FIG. 4, with a wire crimp as the connection end of the present invention.
Figure 6:
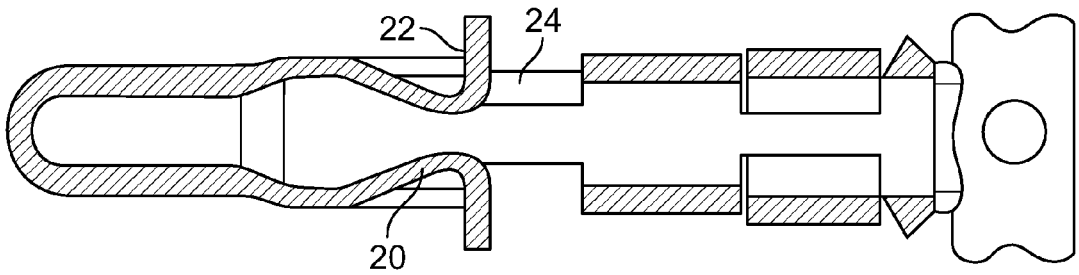
FIG. 6 is a longitudinal cross-sectional of the electrical terminal taken along line 6-6 of FIG. 5 of the present invention.

With reference now to FIGS. 4-6, an alternative embodiment of terminal is shown at 14 having body 16 having a plurality of locking members 18 having a plurality of beam sections 20 and a plurality of locking ends 22, extending through a like plurality of apertures 24. Beam sections 20 and locking ends 22, may be cut outs or stamp outs from body 16. As shown in FIG. 4, terminal 14 includes a contact gripping element 28, whereas in FIG. 5, the terminal 14 includes a wire crimp connection 29.

Figure 7:
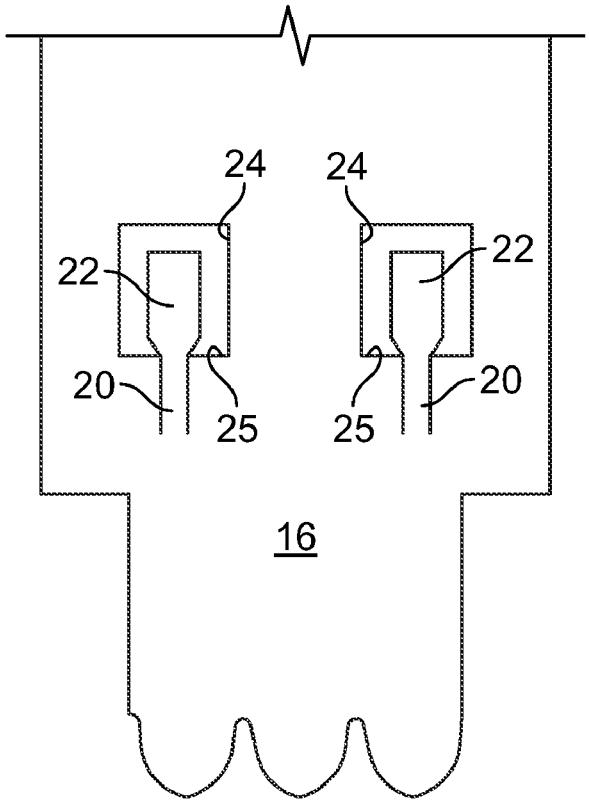
FIG. 7 shows a portion of the stamped blank of the electrical terminal of FIG. 5 of the present invention.

With respect now to FIG. 7, the pin end portion of the terminal 14 is shown in the flat blank condition. As shown, the beam sections 20 and locking ends 22 are stamped from the body portion 16 prior to the forming. It should be appreciated from viewing FIG. 6 that the locking ends 22 are wider than the beam section 20 and thus when stamped and formed into the configuration of FIG. 5, locking ends 22 are positioned adjacent to a forward edge 25 of stamped aperture 24.

More particularly, the locking sections are formed by stretching and compressing the beam sections 20, such that the sections 20 are longer than the apertures 24 through which they were stamped. Thus, when the sections 20 are formed, and as best shown in FIGS. 5 and 6, the locking ends 22 are positioned adjacent to edges 25 which help to reinforce or back up the rigidity in the locking members 18.

Figure 8:
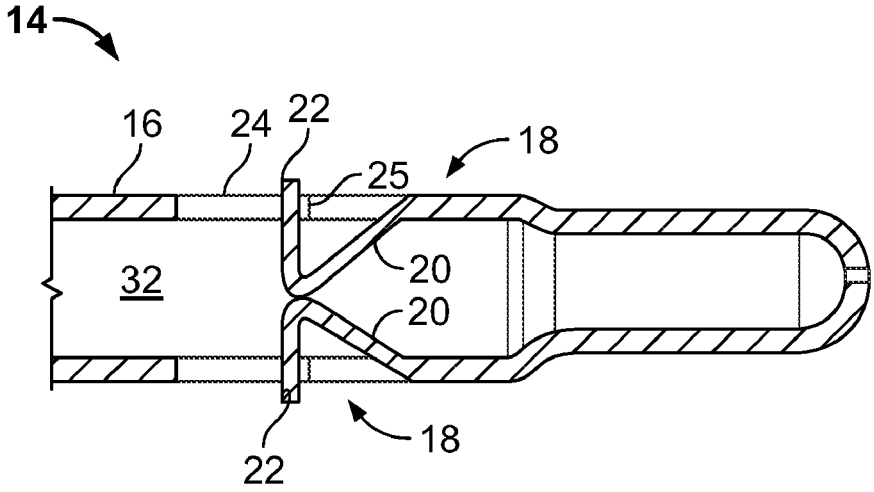
FIG. 8 shows the terminal of FIGS. 5 and 6 with the locking members moved to their fully inward position of the present invention.

At the same time, the sections are formed such that they contact each other when biased inwardly. As shown in FIG. 8, the locking ends are moved inwardly to the position where beam sections are touching. However, the beam sections 20 bottom out before the locking ends 22 extend through their respective aperture 24. This prevents the locking ends from getting caught inside of the terminal body. As the beam sections contact each other, spring back is provided to the beam sections, forcing them back through the apertures 24 after compression. This also prevents undue stress at the root of the connection point of the beam sections 20 and the body 16.

With the individual components as previously described, the function of one embodiment of electrical terminal 2 will now be described in greater detail. The following described function is equally applicable to other disclosed embodiments.

Figure 9:
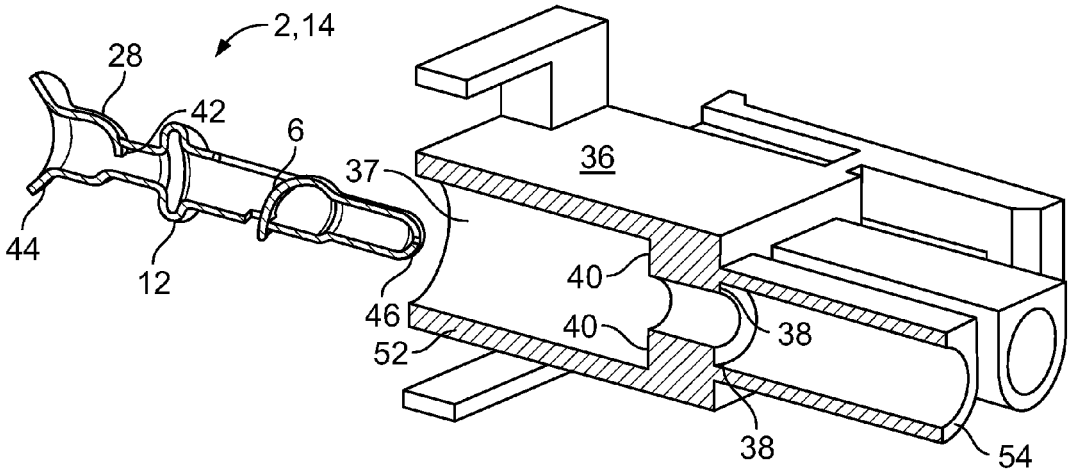
FIG. 9 shows the terminal of FIG. 1 poised for receipt within a connector housing of the present invention.

As best shown in FIG. 9, a connector housing 36 is shown having a cavity or channel 37 into which either of terminals 2 or 14 can be positioned. Channel 37 has a region of reduced cross-section, such as first shoulder 38 and second shoulder 40 disposed between opposed ends 52, 54 of connector housing 36, although the region of reduced cross-section could take other forms, including any form of inwardly directed projections from the surface of channel 37. With respect to FIG. 10, terminal 2 is shown inserted into housing 36, with locking shoulder 8 (FIG. 2) abutting first shoulder 38, and with projection 12 abutting second shoulder 40. Terminal locking shoulder 8 is rigidified by edge 11, reinforcing the locking engagement of terminal 2 to housing 36.

To achieve the installed position of terminal 2 in connector housing 36, an end 46 adjacent locking portion or member 6 is directed into end 52 of connector housing 36. End 46 and locking member 6 pass inside and through the region of reduced cross section defined between shoulders 38, 40 until projection 12 abuts shoulder 40. Just prior to projection 12 abutting second shoulder 40, locking member 6, which is resiliently biased to enable locking member 6 to pass inside the region of reduced cross section, emerges from the region of reduced cross section and returns, or at least partially returns, to its previous unbiased position. In other words, the tip of locking member 6 returns to its unbiased position, or returns to the extent not prevented by channel 37, upon passing through the reduced cross section of channel 37, i.e., extending past first shoulder 38.

Figure 10:
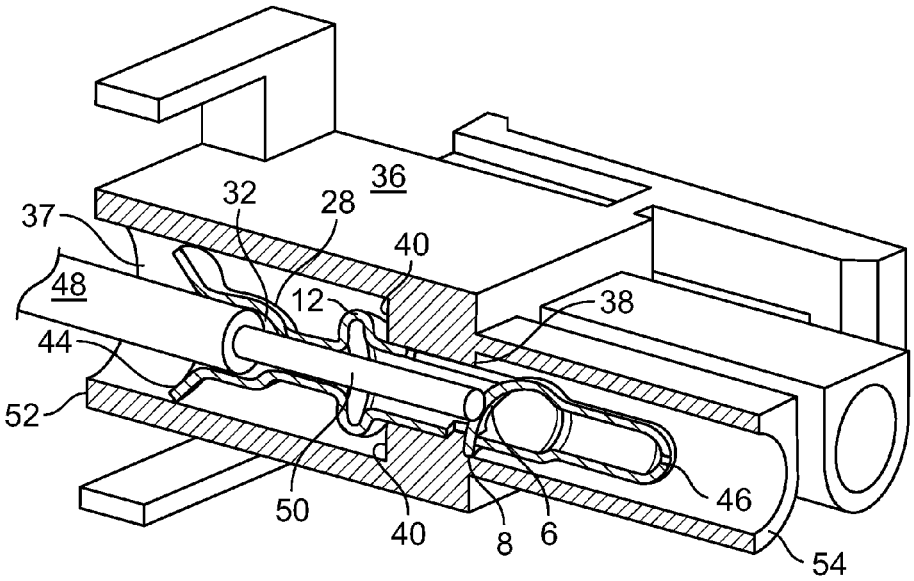
FIG. 10 shows the configuration of FIG. 9, in a fully locked position of the present invention.

Once locking member 6 returns to its unbiased position, the locking member 6 prevents movement of the terminal 2 in the direction opposite the direction of installation, thereby locking the terminal 2 in position in channel 37. A partially stripped wire 48 having a portion of conductor 50 extending therefrom is directed toward end 52 of connector housing 36, into channel 37, toward end 44 of terminal 2, 14 and into channel 32 of the terminal. As shown in FIG. 10, locking member 6 can act as a stop to prevent further penetration of conductor 50 in terminal 2, 14. In addition, as conductor 50 is directed past contact gripping element 28, contact gripping element 28 is resiliently biased by the conductor 50. As a result of the resilient biasing, contact gripping element 28 provides a compressive force against the conductor 50 and the surface of channel 32 opposite the contact gripper element, and achieves a wire trap, substantially preventing the conductor 50 from being moved in a direction opposite that of its installation in the connector housing 36.

Stated another way, contact gripping element 28 is resiliently biased into channel 32. An insulated wire 48 may be prepared such that the conductor 50 is exposed, and the electrical conductor 50 may be inserted through open end 44 and into channel 32 of electrical terminal 2, 14, whereupon distal contact section or end 42 of contact gripping element 28 is resiliently moved in a radial direction to exert a contact gripping and contacting force on the electrical conductor 50.

As longitudinal seam 34 is positioned radially transverse to contact gripping element 28, body 4 can be configured in one embodiment to reduce stress applied on the contact gripping element 6 when an electrical conductor is inserted into channel 32, as the seam can slightly open and relieve the stress in the elongate beam section of contact gripping element 28. As shown in FIG. 10, contact gripping element 28 exerts a contact gripping contact force on electrical conductor 50.

However, in another terminal embodiment which can be used in accordance with this invention, seam 34 could be configured to apply an additional compressive spring force to the conductor 50 to provide improved retention.

It should be appreciated that the embodiment of FIGS. 4-8 would be locked into housing 36 in much the same way with locking ends 22 positioned adjacent shoulder 38, and with projections 26 adjacent to shoulder 40. While not shown, it should be appreciated that locking members could alternatively be formed with the beams 20 extending outside of the body portion, and with locking ends projecting from outside-in, forming an alternative locking shoulder.

FIGS. 11-14 show another embodiment of electrical terminal 56 that is configured to be locked into connector housing 136 and to lockingly receive electrical conductor 50 of wire 48. Electrical terminal 56 is otherwise similar to electrical terminal embodiments 2, 14 except as discussed in further detail below. These differences in the construction of electrical terminal 56 permit electrical terminal 56 to be installed in connector housing 136 from the opposite end than conductor 50 is installed in the connector housing. By virtue of electrical terminal 56 being installed in the opposite direction as conductor 50, electrical terminal 56 achieves improved locking retention in electrical housing 136 when subjected to forces associated with attempting to remove conductor 50 from electrical terminal 56 by pulling wire 48 in a direction away from connector housing 136.

Figure 12:
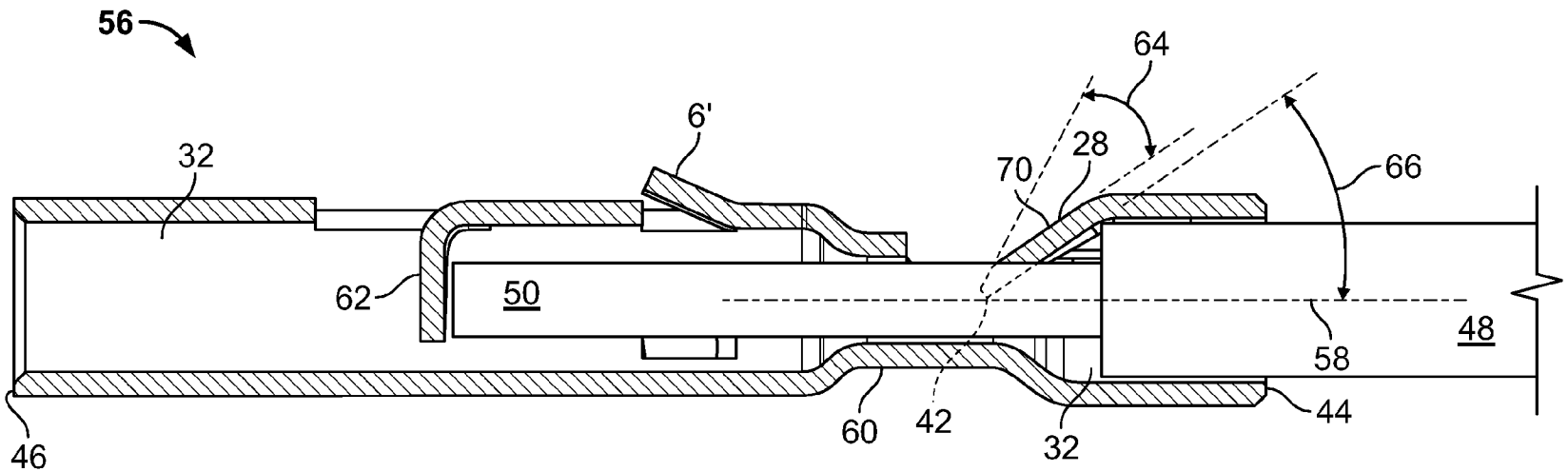
FIG. 12 is a longitudinal cross-sectional view of the embodiment of the electrical terminal of FIG. 11 of the present invention.
Figure 13:
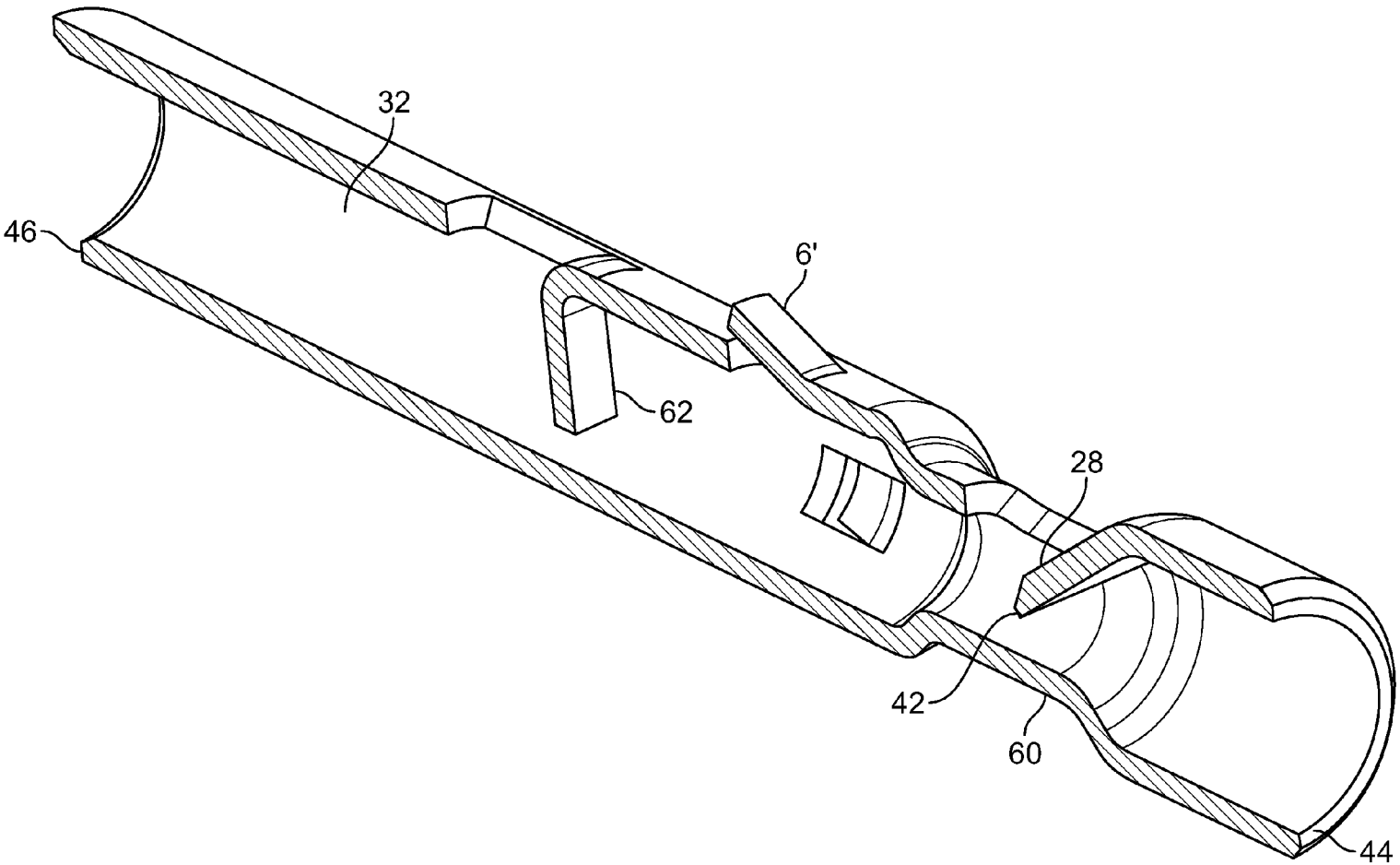
FIG. 13 is a perspective cross-sectional view of the embodiment of the electrical terminal of FIG. 11 of the present invention.

As shown in FIG. 12, conductor 50 of insulated wire 48 is installed in electrical terminal 56 by directing conductor 50 toward end 44 and entering channel 32 until conductor 50 abuts stop 62. Stop 62 is shown as a tab that is biased inwardly into channel 32, although end 46 could also include a region of reduced cross-sectional area to prevent further insertion of conductor 50 in channel 32. Prior to conductor 50 abutting stop 62, conductor 50 is brought into resilient compressive contact with distal end 42 of contact gripping element 28. In one embodiment, this compressive contact is achieved, or at least the magnitude of the compressive contact is increased, due to a region of reduced cross-section or neck 60 formed adjacent contact gripping element 28. This region of reduced cross-section is preferably circular, but could have a non-circular profile if desired. Contact gripping element 28 is disposed at an angle 66 to an axis 58, such as a center axis in channel 32, with end 42 being directed toward end 46 of the electrical terminal 56. In one embodiment, angle 64 is about 35 degrees, with contact gripping element 28 defining a substantially straight or linear (noncurved) profile. In another embodiment, angle 64 can range from about 20 degrees to about 50 degrees.

In addition to angle 66, end 42 of contact gripping element 28 is constructed to be of reduced thickness to achieve improved retention of conductor 50. In a preferred embodiment, this reduced thickness is achieved by a chamfer formed at an angle 64 of about 30 degrees from a surface 70 of contact gripping element 28. In another embodiment, the chamfer angle 64 is at least 20 degrees, but other angular magnitudes can range from about 20 degrees to about 50 degrees, although still other angles less than 20 degrees or greater than 50 degrees can be used. Although a chamfer is directed to removal or forming of material resulting in a planar surface, it is to be understood that removal or forming of material resulting in a reduced thickness of end 42 may be achieved having a nonplanar, and even curved surface adjacent end 42. In addition, the magnitude of the reduced thickness of end 42 is preferably less than half of the original material thickness used to construct the contact gripping element 28, although a lesser percentage reduction is possible. In one embodiment, the thickness is between about 0.007 and 0.003 inch. By reducing the thickness of end 42 of contact gripping element 28, a condition known as skipping is substantially eliminated. Skipping can occur when end 42 fails to maintain physical contact with the surface of conductor 50 when an axial force is applied in a direction opposite the direction of installation of the conductor 50 in the terminal 2. In other words, when subjected to an axial removal force, end 42 fails to properly engage conductor 50, permitting at least partial removal of conductor 50 from terminal 2.

Reducing the thickness of end 42, while not necessarily reduced to the extent produced by sharpening end 42 to a keen or pointed edge, helps provide enhanced retention of the conductor 50. In addition, sharpening end 42 to a keen or pointed edge can cause end 42 to slice through and sever conductor 50 as a result of an axial removal force applied to conductor 50. Therefore, the axial removal force associated with an end 42 having a keen or pointed edge is less, and typically considerably less, than the axial removal force associated with an end 42 having a reduced thickness that has not been sharpened to a keen or pointed edge.

It is to be understood that the actual dimension of reduced thickness of the end 42, the magnitude of the angle 64 of chamfer, the magnitude of angle 66 can vary depending upon the material used to construct electrical terminal 56, the thickness of the material of the electrical terminal, the length of contact gripping element and the amount of constriction of neck 60, among other material or environmental parameters, so that varying any one of these parameters can affect the optimum retention of conductor 50. In one embodiment, sufficient forces associated with removal of conductor 50 results in contact gripping element 28 collapsing upon itself, versus the contact gripping element 28 releasing its hold from conductor 50. It is also to be understood that while the end 42 is shown as a straight or linear, that nonlinear profiles can also be used.

Figure 14:
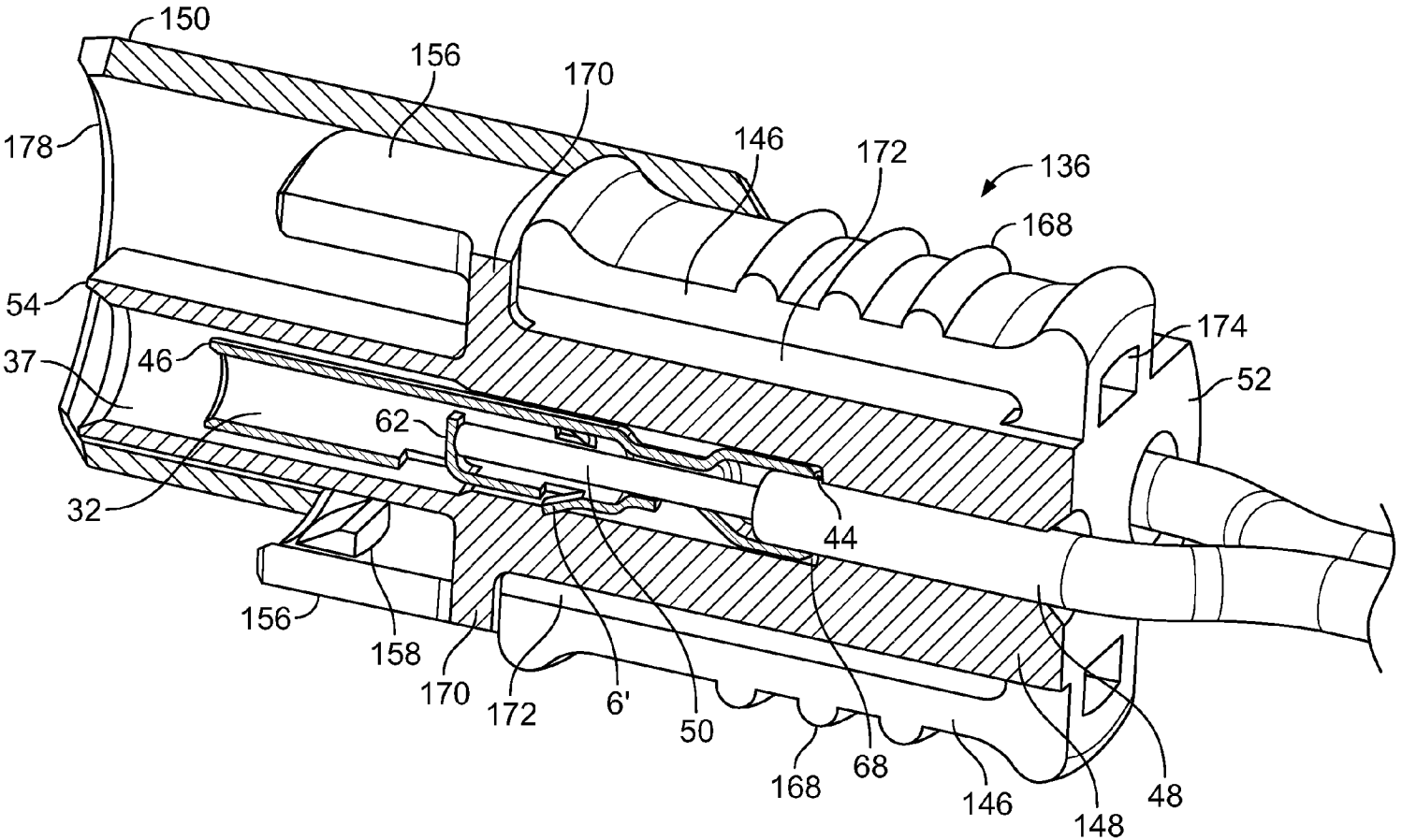
FIG. 14 is a perspective cross-sectional view of the embodiment of the electrical terminal of FIG. 11 installed in a fully locked position inside a connector housing of the present invention.

To achieve the installed position of terminal 56 in connector housing 136, end 44 adjacent contact gripping element 28 is directed into end 54 of connector housing 136. End 44 is further directed inside channel 37 until end 44 abuts a region of reduced cross-section, such as a shoulder 68 as shown in FIG. 14. Preferably, end 44 is sized for slidable insertion inside channel 37 without interference, but with little additional clearance. Similarly, it is also preferable that channel 32 is sized for slidable insertion of wire 48 inside channel 32, but with little additional clearance. By virtue of such minimal clearance conditions, end 44 of electrical terminal 56 is further prevented from buckling, thereby substantially increasing the amount of force required to remove terminal 56 by urging the terminal past shoulder 68 for removal of the terminal through end 52 of the connector housing 136. Preventing removal of electrical terminal 56 from connector housing 136 through end 54 of the connector housing are one or more locking members 6' that engage the surface of channel 37. The ends of locking members 6' become effectively entrenched, engaging the surface of channel 37 in a fashion similar to end 42 of the contact gripping element.

Referring to FIGS. 11, 14 and 15-19 is one embodiment of an electrical connector assembly between connector housings 136, 138. An embodiment of terminal 56 is used to provide electrical connection through connector housings 136, 138. It is to be understood that connector housings 136, 138 and terminals 56 include similar features with other embodiments previously discussed, except as discussed in further detail below.

Figure 15:
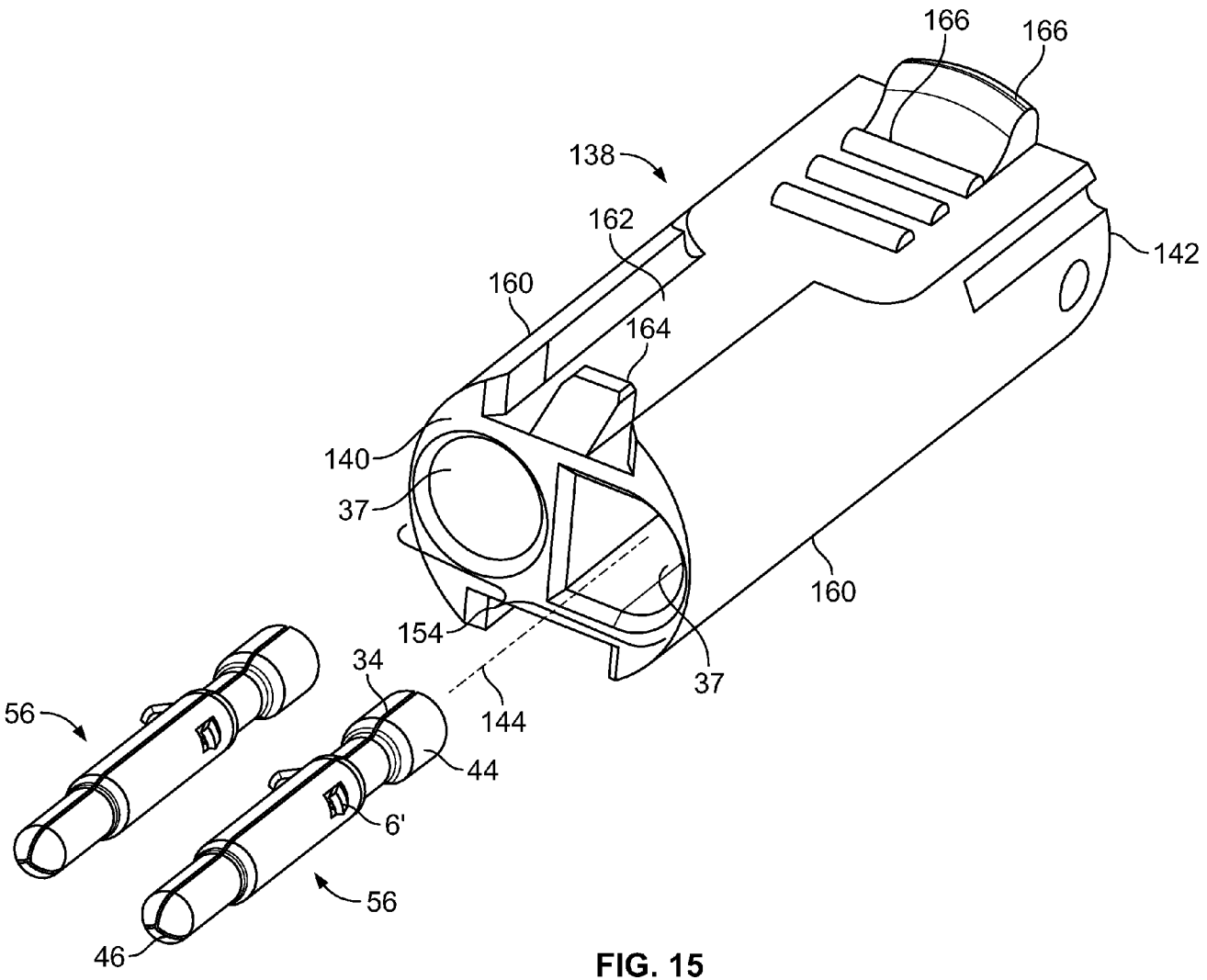
FIG. 15 is an exploded perspective view of a further embodiment of a connector housing that mates with the connector housing of FIG. 11 of the present invention.
Figure 16:
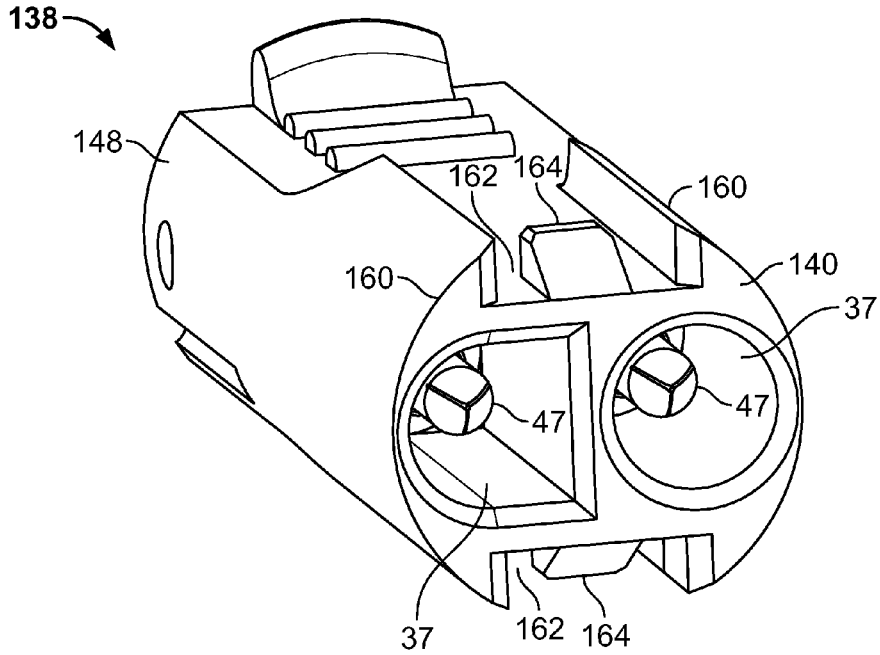
FIG. 16 is a perspective view of the connector housing of FIG. 15 of the present invention.
Figure 17:
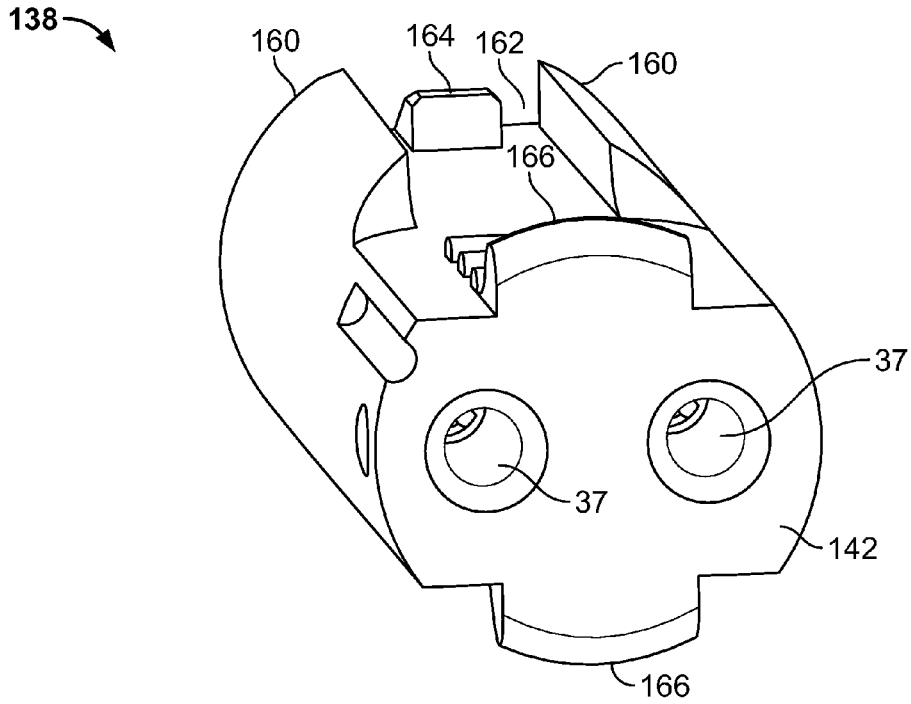
FIG. 17 is a reverse perspective view of the connector housing of FIG. 16 of the present invention.
Figure 18:
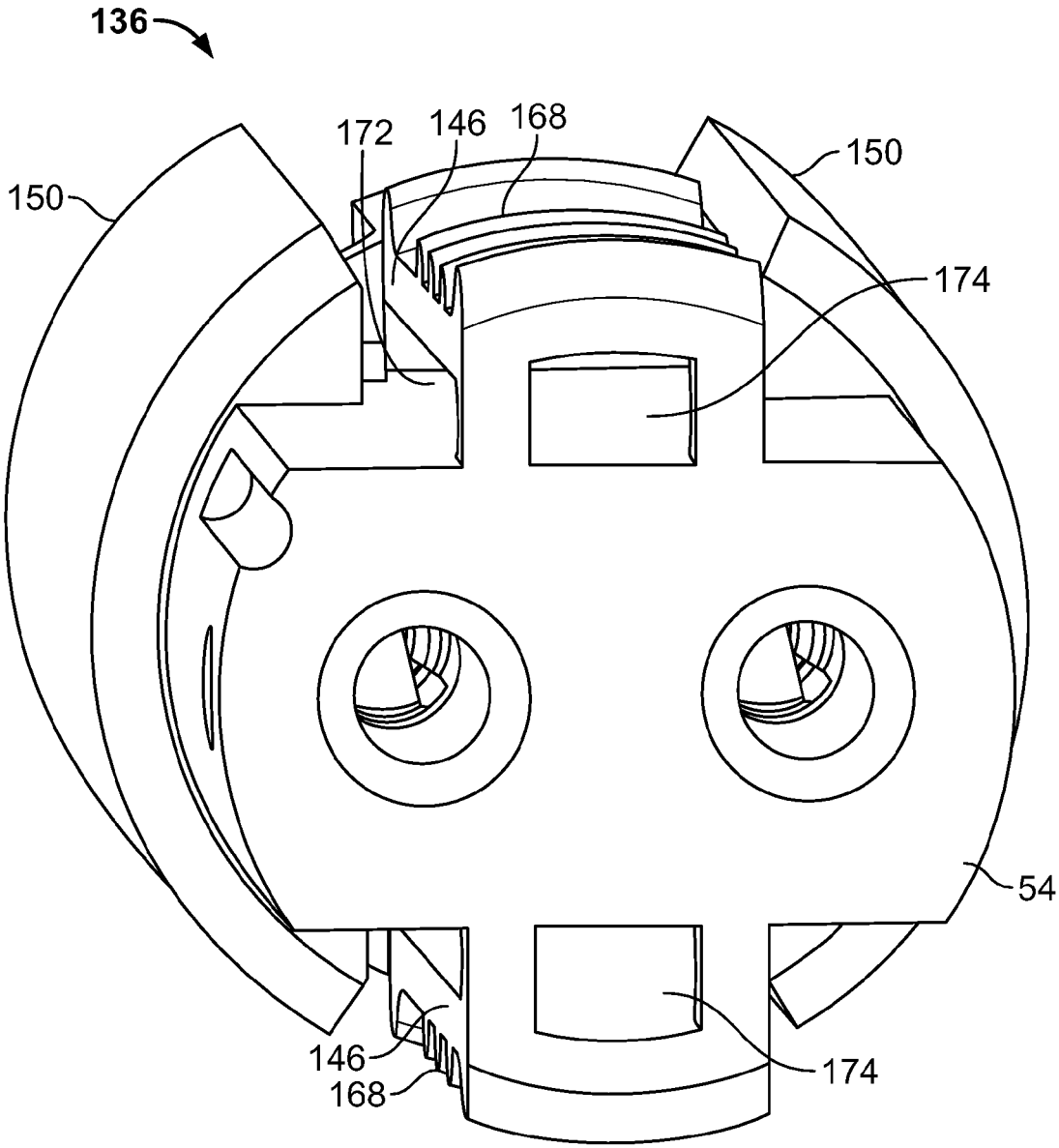
FIG. 18 is a perspective view of a connector housing of FIG. 11 of the present invention.
Figure 19:
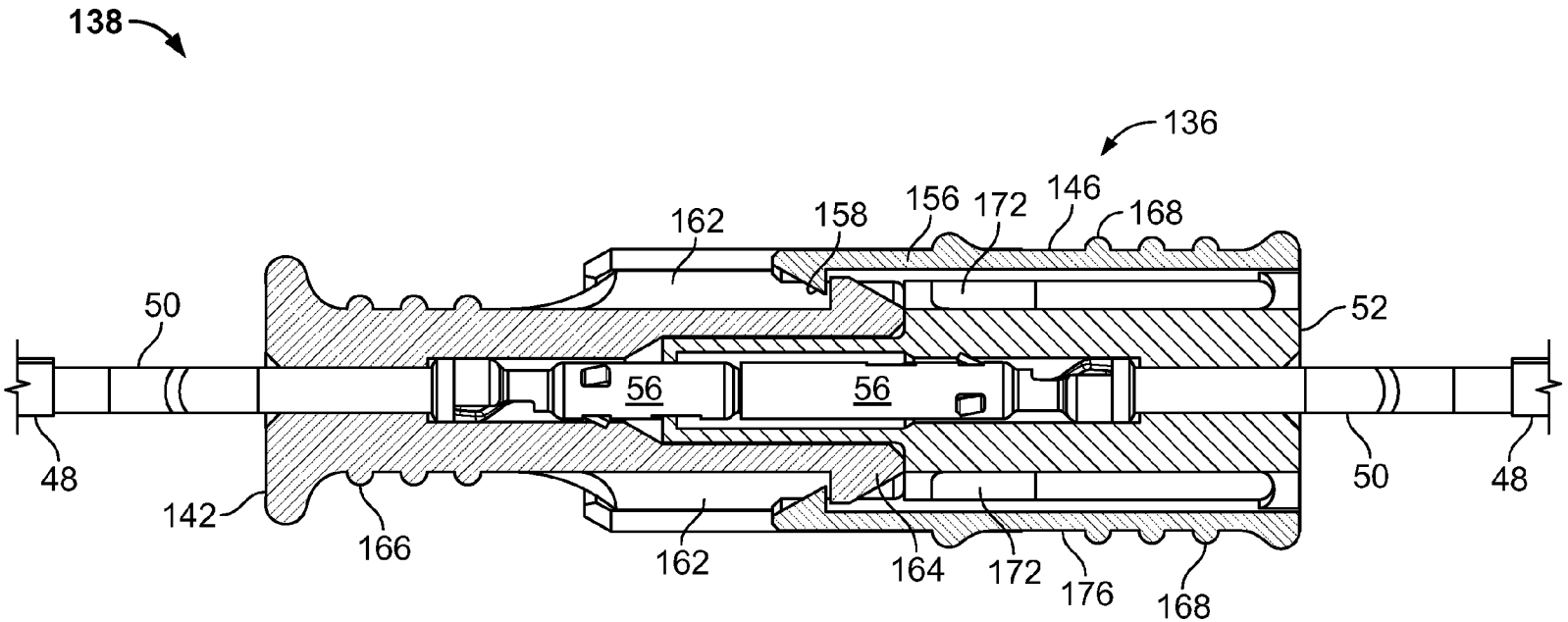
FIG. 19 is a cross-sectional view of engaged or connected connector housings of FIGS. 11 and 15 of the present invention.

As shown in FIGS. 11, 14, 18 and 19, connector housing 136 includes opposed ends 54, 52 defining channel 37 for receiving terminals 56 therein. In the embodiment shown (FIG. 11), channel 37 includes a longitudinal axis 144 for receiving terminal 56, although another terminal 56 is disposed in the other channel 37 in an orientation that is substantially parallel to axis 144. The portion of connector housing 136 adjacent to end 54 defines a keying arrangement 152 that ensures the desired terminals 56 of connector housing 136 can only mate with the desired terminals 56 of connector housing 138 (FIG. 15). Connector housing 136 includes an extension portion 150, such as one or more curved portions, that extend longitudinally past end 54. As shown, extension portion 150 includes an opposed pair of curved portions that are disposed along the periphery of connector housing 136 and sufficiently spaced to receive an end 140 of connector housing 138.

One embodiment of connector housing 136 further includes a pair of opposed non-cantilevered resilient portions 146 (FIG. 14), each non-cantilevered resilient portion 146 including a gripping portion 168. Non-cantilevered resilient portion 146 is disposed between end 52 and a pivot portion 170 (FIG. 14), with a gap 172 separating all but the opposed ends of each non-cantilevered resilient portion 146 from a base 148 of connector housing 136. An opening 174 (FIGS. 14, 18) is formed in the end of non-cantilevered resilient portion 146 that is adjacent to end 52 of connector housing 136. Opening 174 reduces the magnitude of a compressive force that must be applied to gripping portions 168 to urge elastic deformation of the mid-spans of each non-cantilevered resilient portion 146 toward base 148 of connector housing 136. The end of each non-cantilevered resilient portion 146 opposite end 52 of connector housing 136 is secured to a pivot portion 170 (FIG. 14) having an end that extends radially outward from base 148. At the end of pivot portion 170 that is opposite base 148, pivot portion 170 extends to a flange 156 (FIGS. 11, 14, 19) that is spaced at a predetermined distance from base 148. Flange 156 includes a retainer 158 (FIGS. 14, 19) that is extends inwardly toward base 148. Retainer 158 engages a corresponding retainer 164 (FIGS. 15, 19) formed in connector housing 138 to secure connector housings 136, 138 in a mated or connected position.

As a result of a compressive force applied to the non-cantilevered resilient portions 146, elastic deformation of each non-cantilevered resilient portion 146 toward base 148 pivotably urges pivot portion 170 toward end 52 of connector housing 136. In response to the pivoting movement of pivot portion 170, the end of flange 156 opposite pivot portion 170, including retainer 158, is urged away from base 148 of connector housing 136. Sufficient movement of retainer 158 disengages retainer 158 from retainer 164 of connector housing 138 (FIG. 19), permitting connector housings 136, 138 to be disconnected from each other. Upon grasping a gripping portion 166 of connector housing 138 while the compressive force is being applied to gripping portion 168 of connector housing 136, application of a separation force that is parallel to axis 144 (FIGS. 11, 15) disengages and separates connector housings 136, 138 from each other.

Figure 11:
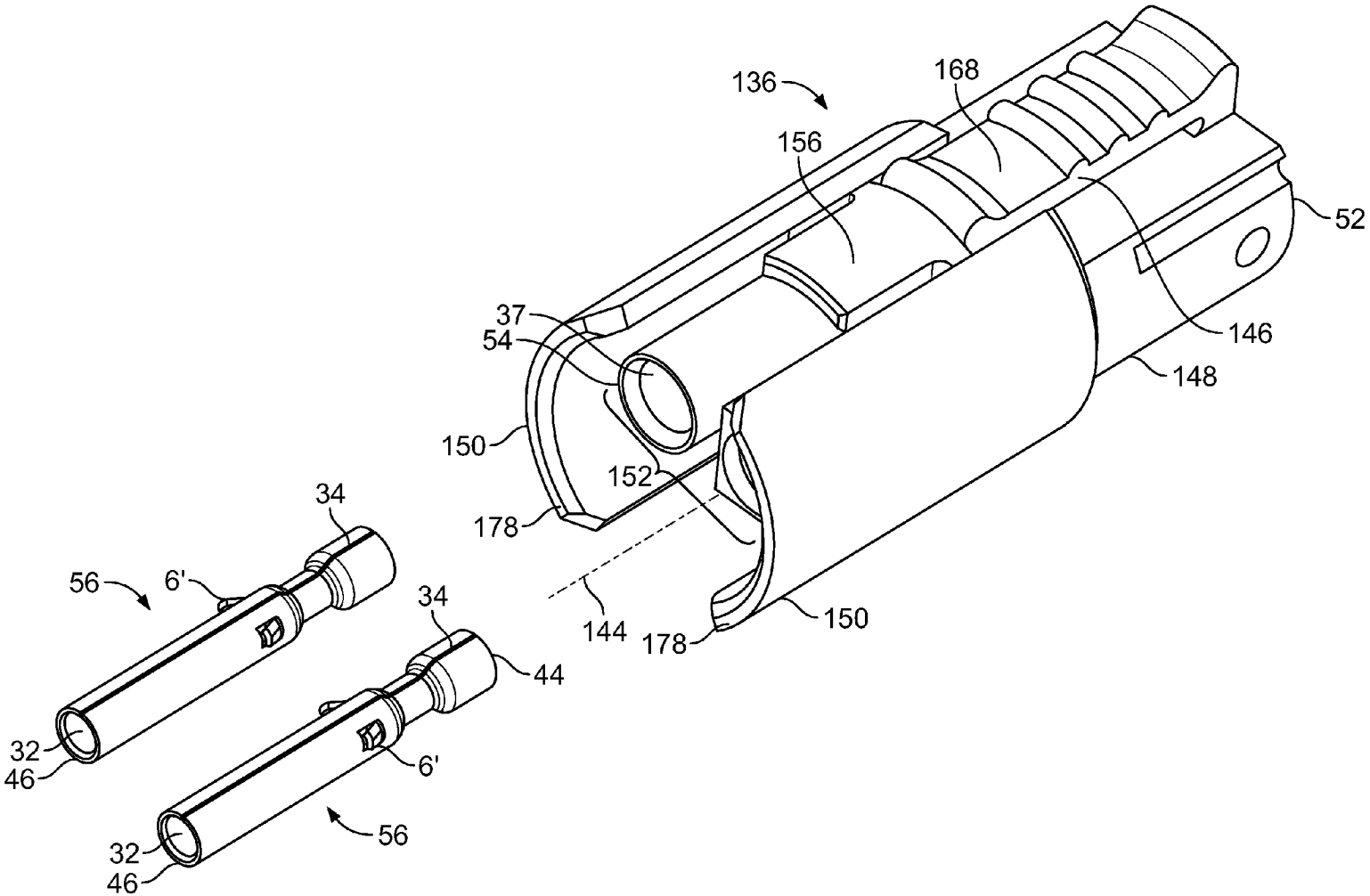
FIG. 11 is an exploded perspective view of a further embodiment of an electrical terminal for insertion into a connector housing of the present invention.

Referring to FIGS. 15-17 and 19, one embodiment of connector housing 138 includes opposed ends 140, 142 defining channel 37 for receiving terminals 56 therein. In the embodiment shown (FIG. 15), channel 37 includes a longitudinal axis 144 for receiving terminal 56, although another terminal 56 is disposed in the other channel 37 in an orientation that is parallel to axis 144. The portion of connector housing 138 adjacent to end 140 defines a keying arrangement 154 that ensures the desired terminals 56 of connector housing 138 can only mate with the desired terminals 56 of connector housing 136 (FIG. 11). Connector housing 138 includes opposed curved portions 160, although a single curved portion could also be used, that extend longitudinally between end 140 toward end 142. Disposed between each pair of adjacent ends of curved portions 160 is a ridge 162. Retainer 164 is formed in ridge 162 adjacent to end 140 with retainer 164 being recessed with respect to the adjacent ends of curved portions 160. Retainer 164 engages retainer 158 of connector housing 136 to secure connector housings 136, 138 to each other when in a connected position.

The novel construction of connector housings 136, 138 permit "blind assembly" of connector housings 136, 138 to each other. The term blind assembly is defined to mean that connector housings 136, 138 can be assembled to each other without requiring the installer to visually perceive the connector housings 136, 138 while attempting to engage or connect the connector housings 136, 138. Achieving blind assembly with known art connector housing constructions is extremely difficult unless the installer possesses extraordinary manual dexterity and coordination, or is lucky. This need for visual perception is typically required, since the connector housings require simultaneous axial alignment and alignment of keying arrangements before any meaningful amount of mating engagement could begin to occur.

While the connector housings 136, 138 of the present invention still require simultaneous axial alignment and alignment of keying arrangement before mating engagement can occur, the provision of extension portion 150 (FIGS. 11, 14, 19) provides a partial preliminary assembly or staging position of the connector housings 136, 138 not previously available in the known art constructions. This staging position is made possible due to the end 54 of connector housing 136 being recessed with respect to end 178 of extension portion 150 as measured along longitudinal axis 144 (FIG. 11). That is, ends 178 of extension portion 150 longitudinally extend past the ends 54 of connector housing 136, thereby partially receiving or permitting partial insertion of end 140 of connector housing 138 inside extension portion 150. By virtue of this partial insertion, a degree of stability is provided in that mating ends 54, 140 of connector housings 136, 138 can be brought into contact and easily maintained in contact by an installer having reasonable manual dexterity and coordination.

Once partial preliminary assembly has been achieved, as described above, by virtue of the curved portions 160 defining an oval slot that is conformally received by the larger oval slot defined by the inside surfaces of extension portion 150, the ends 54, 140 of the connector housings 136, 138 are substantially guided into axial alignment. However, in addition to axial alignment, to achieve connection of the connector housings 136, 138, the keying arrangements 152, 154 (FIGS. 11, 15) of the connector housings 136, 138 must also be guided into substantial alignment. That is, as appreciated by those having ordinary skill in the art, upon achieving partial preliminary assembly, the keying arrangements 152, 154 (FIGS. 11, 15) are either substantially aligned, which would be extremely fortuitous, or are misaligned. An installer possessing reasonable manual dexterity and coordination can then easily manipulate end 52 of connector housing 136 with respect to end 142 of connector housing 138, without the need to actually view the connector housings 136, 138, to determine whether the keying arrangements 152, 154 are properly aligned. If the keying arrangements 152, 154 are not properly aligned, the installer merely needs to rotate one of the connector housings 136, 138 about a longitudinal axis that is parallel to axis 144 (FIG. 11, 15).

Alternately, the installer can rotate both of the computer housings 136, 138 about a longitudinal axis that is parallel to axis 144 (FIG. 11, 15), either in the same or opposite directions, so long as the relative orientation of keying arrangements 152, 154 (FIGS. 11, 15) change with respect to each other to permit alignment of the keying arrangements 152, 154. Once this rotation(s) about the longitudinal axis is completed, which then substantially provides alignment of keying arrangements 152, 154, subtle, easily performed manipulations can then be used to achieve axial alignment, thereby permitting connection of the connector housings 136, 138. It is especially the case that subtle, easily performed manipulations can then be used to achieve axial alignment when the ends 54, 140 of the connector housings 136, 138 are maintained in substantially continuous physical contact during the rotation(s) of the connector housings 136, 138.

However, it is to be understood that even when substantially continuous physical contact between the ends 54, 140 of connector housings 136, 138 is not maintained, or possibly not ever established during the rotation(s) of connector housings 136, 138, by maintaining sufficient partial preliminary assembly between end 140 of connector housing 138 inside extension portion 150, substantial axial alignment between connector housings 136, 138 is similarly maintained.

It is to be understood that the widths or angular arrangements of the ridges 162 (FIG. 15) can be varied with respect to each other in order to provide a second keying arrangement that would not permit partial preliminary assembly. In such case, rotation about an longitudinal axis of one connector housing with respect to the other connector housing as described above permits partial preliminary assembly with the knowledge that substantial alignment of keying arrangements 152, 154 (FIGS. 11, 15) can be easily achieved.

In summary, extension portion 150 permits partial preliminary assembly which provides additional stability for achieving connection without requiring visual perception of the connectors. Such capability is extremely desirable where there is a lack of light and/or an extremely limited or awkward installation environment. In such instances, once the wires leading to the connector housings are determined, it is possible simply to grasp one wire in each hand, sliding the wires through each hand until a connector housing rests in each hand. Once a connector housing is positioned in each hand, the connector housings can be easily connected, as previously discussed. Therefore, it is a relatively straightforward matter to both locate and assemble or connect/engage or disconnect/disengage connector housings without benefit of visual assistance.

It is to be understood that while the extension portion 150 (FIG. 11) is shown as a pair of curved members of connector housing 136 with conformally fitting curved portions 160 (FIG. 15) other geometrically shaped constructions and numbers of members, i.e., one or three or more curved members, are possible.

An additional advantageous aspect of the connector housings 136, 138 is that upon connection therebetween, the external surface 176 (FIG. 19) of the connector housings 136, 138 substantially lacks external features capable of inadvertently capturing a portion of an element brought into physical contact with the external surface 176. In one application, connector housings 136, 138 and the required wiring for a component, such as a fluorescent light fixture can be assembled. That is, a fluorescent light fixture would include the wiring and electrical connectors, with additional wire provided to splice to the facility wiring into which the light fixture is to be installed. To reduce costs associated with this arrangement, such as could be the case with certain retail chains of hardware stores, one shipping container could contain multiple light fixture assemblies. In such cases, there have been problems associated with wiring from one light fixture assembly being captured by the connector housings associated with a different light fixture assembly, resulting in damage to at least one of the wiring, connector housings or light fixture assembly. Known art connector housings may contain features, such as cantilevered portions, which could capture wires and ultimately result in damage. The assembled connector housings substantially lack external features capable of inadvertently capturing or (snagging) portions of an elements brought into physical contact with the assembled connector housings. While the external features of the assembled or connected connector housings may not resemble a flat or otherwise featureless profile, it is appreciated that there is a substantial lack of features having a pronounced jutting or protruding aspect or exposed gaps that are susceptible to inadvertently capture other elements brought into physical contact with the assembled connector housings.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrical terminal for positioning in a connector housing comprising:

a body having a first end, a second end, and a channel, the channel having an axis extending at least through the first end toward the second end, the channel configured and disposed to receive an electrical conductor;

a contact gripping element intermediate the first and second ends extending into the channel at an angle from the axis, the contact gripping element associated with the body, the contact gripping element terminating at an end having a reduced thickness, the contact gripping element configured to exert a contact gripping contact force on the electrical conductor; and the body comprising a locking portion configured to lock the body in the connector housing, the locking portion defining a locking shoulder, and the locking portion being positioned through the channel, whereby the locking shoulder is backed up by the body.

2. The electrical terminal of claim 1 wherein the angle is in the range of from about 20 degrees to about 50 degrees.

3. The electrical terminal of claim 1 wherein the reduced thickness is due to a chamfer.

4. The electrical terminal of claim 1 wherein the reduced thickness is less than about 0.08 inch.

5. The electrical terminal of claim 1 wherein the reduced thickness is less than about 0.01 inch.

6. The electrical terminal of claim 1 wherein the reduced thickness is between about 0.007 inch and 0.003 inch.

7. The electrical terminal of claim 1 wherein a region of the body adjacent the contact gripping element is of reduced cross section.

8. The electrical terminal of claim 1 wherein the body and contact gripping element are of unitary construction.

9. The electrical terminal of claim 1 wherein the body has a projection intermediate the first end and the locking shoulder, the connector housing having a second channel to receive the body, the second channel having a region of reduced cross section, upon the second end of the body being installed in the second channel of the connector housing, the locking shoulder being directed through the region of reduced cross section so that the region of reduced cross section is intermediate the locking shoulder and the projection to thereby lock the body in the connector housing.

10. The electrical terminal of claim 1 wherein the contact gripping element is substantially straight and the end of the contact gripping element is substantially transverse to the axis.

11. The electrical terminal of claim 1 wherein the reduced thickness is due to a chamfer in the range of from about 20 degrees to about 50 degrees and wherein the end of the contact gripping element is between about 0.007 inch and 0.003 inch.

12. An electrical terminal for positioning in a connector housing comprising:

a body having a first end, a second end, and a channel having an axis extending at least through the first end toward the second end, the channel configured and disposed to receive an electrical conductor;

a contact gripping element intermediate the first and second ends extending into the channel at an angle from the axis, the contact gripping element associated with the body, the contact gripping element terminating at an end having a reduced thickness, the contact gripping element configured to exert a contact gripping contact force on the electrical conductor; and the body comprising a locking portion configured to lock the body in the connector housing, the locking portion defining a locking shoulder, and the locking portion being positioned through the channel, whereby the locking shoulder is backed up by the body;

wherein the body has a projection intermediate the second end and the contact gripping element, the connector housing having a second channel to receive the body, the second channel having a region of reduced cross section, upon the first end of the body being installed in the second channel of the connector housing, the first end of the body abutting the region of reduced cross section of the second channel and the projection engaging the surface of the second channel to thereby lock the body in the connector housing.

13. The electrical terminal of claim 12 wherein the contact gripping element is substantially straight and the end of the contact gripping element is substantially transverse to the axis.

14. The electrical terminal of claim 12 wherein the reduced thickness is due to a chamfer in the range of from about 20 degrees to about 50 degrees and wherein the end of the contact gripping element is between about 0.007 inch and 0.003 inch.

15. The electrical terminal of claim 12 wherein the angle is in the range of from about 20 degrees to about 50 degrees.

16. The electrical terminal of claim 12 wherein the reduced thickness is due to a chamfer.

17. The electrical terminal of claim 12 wherein the reduced thickness is less than about 0.08 inch.

18. The electrical terminal of claim 12 wherein the reduced thickness is less than about 0.01 inch.

19. The electrical terminal of claim 12 wherein the reduced thickness is between about 0.007 inch and 0.003 inch.

20. The electrical terminal of claim 12 wherein the body and contact gripping element are of unitary construction.

* * * * *